US009411310B1

(12) United States Patent
Kiuchi et al.

(10) Patent No.: US 9,411,310 B1
(45) Date of Patent: Aug. 9, 2016

(54) COOLING DEVICE, IMAGE FORMING APPARATUS, AND COOLING METHOD

(71) Applicant: FUJI XEROX CO., LTD., Tokyo (JP)

(72) Inventors: Yutaka Kiuchi, Tokyo (JP); Kazuhiko Arai, Kanagawa (JP); Kazunori Numao, Kanagawa (JP); Masayo Higashimura, Kanagawa (JP); Masayoshi Nakao, Kanagawa (JP); Kunihiko Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/806,278

(22) Filed: Jul. 22, 2015

(30) Foreign Application Priority Data

Jan. 28, 2015 (JP) ..... 2015-014595

(51) Int. Cl.
*G03G 15/20* (2006.01)
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS 5,495,324 A * 2/1996 Kopp ..... G03G 15/2003 219/216
5,568,241 A * 10/1996 Creutzmann ..... G03G 15/2003 219/216
5,835,830 A * 11/1998 Fukuda ..... G03G 9/0821 399/307
5,920,759 A * 7/1999 Ushiroji ..... B65H 29/12 162/271
5,933,694 A * 8/1999 Yamashita ..... G03G 15/161 399/307
5,956,554 A * 9/1999 Yanashima ..... G03G 15/2064 399/328

(Continued)

FOREIGN PATENT DOCUMENTS

JP 09330006 A * 12/1997
JP 2004-203527 A 7/2004

(Continued)

OTHER PUBLICATIONS

Communication dated Aug. 11, 2015 from the Japanese Patent Office in counterpart application No. 2015-014595.

*Primary Examiner* — David Bolduc
(74) *Attorney, Agent, or Firm* — Sughrue Mion, PLLC

(57) ABSTRACT

A cooling device cools a continuous resin film, which is transported and onto which a toner image is transferred, after the toner image is heated so that the toner image is fixed to the resin film. The resin film to which the toner image is fixed is cooled in such a manner that an image surface side of the resin film is convexly curved.

8 Claims, 9 Drawing Sheets

(56) References Cited

U.S. PATENT DOCUMENTS 6,175,715 B1 * 1/2001 Hirao ..... G03G 15/231 399/384
7,356,300 B2 * 4/2008 Kamiyama ..... G03G 15/20 399/341
2002/0168212 A1 * 11/2002 Nedblake, Jr. ..... B41J 11/0015 400/621
2003/0063930 A1 * 4/2003 Kiuchi ..... G03G 15/161 399/307
2004/0131406 A1 * 7/2004 Ohki ..... G03G 15/6576 399/384
2005/0025540 A1 * 2/2005 Murai ..... G03G 15/2064 399/341
2005/0201795 A1 * 9/2005 Kawachi ..... B65H 29/52 399/406
2010/0221048 A1 * 9/2010 Shiozawa ..... G03G 15/2064 399/328
2010/0226681 A1 * 9/2010 Okuda ..... G03G 15/2064 399/92
2011/0008087 A1 * 1/2011 Inoue ..... B65H 85/00 399/341
2011/0064468 A1 * 3/2011 Kawahata ..... G03G 15/2053 399/122
2011/0142467 A1 * 6/2011 Ohhashi ..... G03G 15/2039 399/67
2011/0164907 A1 * 7/2011 Yamano ..... G03G 15/6573 399/341
2012/0009349 A1 * 1/2012 Shinokawa ..... C23C 14/562 427/294
2012/0269542 A1 * 10/2012 Kosasa ..... G03G 15/2032 399/341
2012/0315070 A1 * 12/2012 Harashima ..... G03G 15/0189 399/341
2012/0321362 A1 * 12/2012 Hirota ..... G03G 15/657 399/341
2012/0328343 A1 * 12/2012 Kunii ..... G03G 15/0189 399/341
2013/0004220 A1 * 1/2013 Muramatsu ..... G03G 15/2021 399/329
2013/0149017 A1 * 6/2013 Amita ..... G03G 15/2078 399/341
2014/0029995 A1 1/2014 Okuda
2014/0233996 A1 * 8/2014 Ikeda ..... G03G 21/20 399/341
2015/0071677 A1 * 3/2015 Hirasawa ..... G03G 21/206 399/94

FOREIGN PATENT DOCUMENTS

JP 2004-205689 A 7/2004
JP 2007101615 A * 4/2007
JP 2009-161347 A 7/2009
JP 2012-37545 A 2/2012
JP 2014-26103 A 2/2014

* cited by examiner

COOLING DEVICE, IMAGE FORMING APPARATUS, AND COOLING METHOD

CROSS-REFERENCE TO RELATED APPLICATIONS

This application is based on and claims priority under 35 USC 119 from Japanese Patent Application No. 2015-014595 filed Jan. 28, 2015.

BACKGROUND

Technical Field

The present invention relates to a cooling device, an image forming apparatus, and a cooling method.

SUMMARY

According to an aspect of the invention, there is provided a cooling device that cools a continuous resin film, which is transported and onto which a toner image is transferred, after the toner image is heated so that the toner image is fixed to the resin film, the resin film to which the toner image is fixed being cooled in such a manner that an image surface side of the resin film is convexly curved.

BRIEF DESCRIPTION OF THE DRAWINGS

Exemplary embodiments of the present invention will be described in detail based on the following figure, wherein.

DETAILED DESCRIPTION

First Exemplary Embodiment

Figure 1:
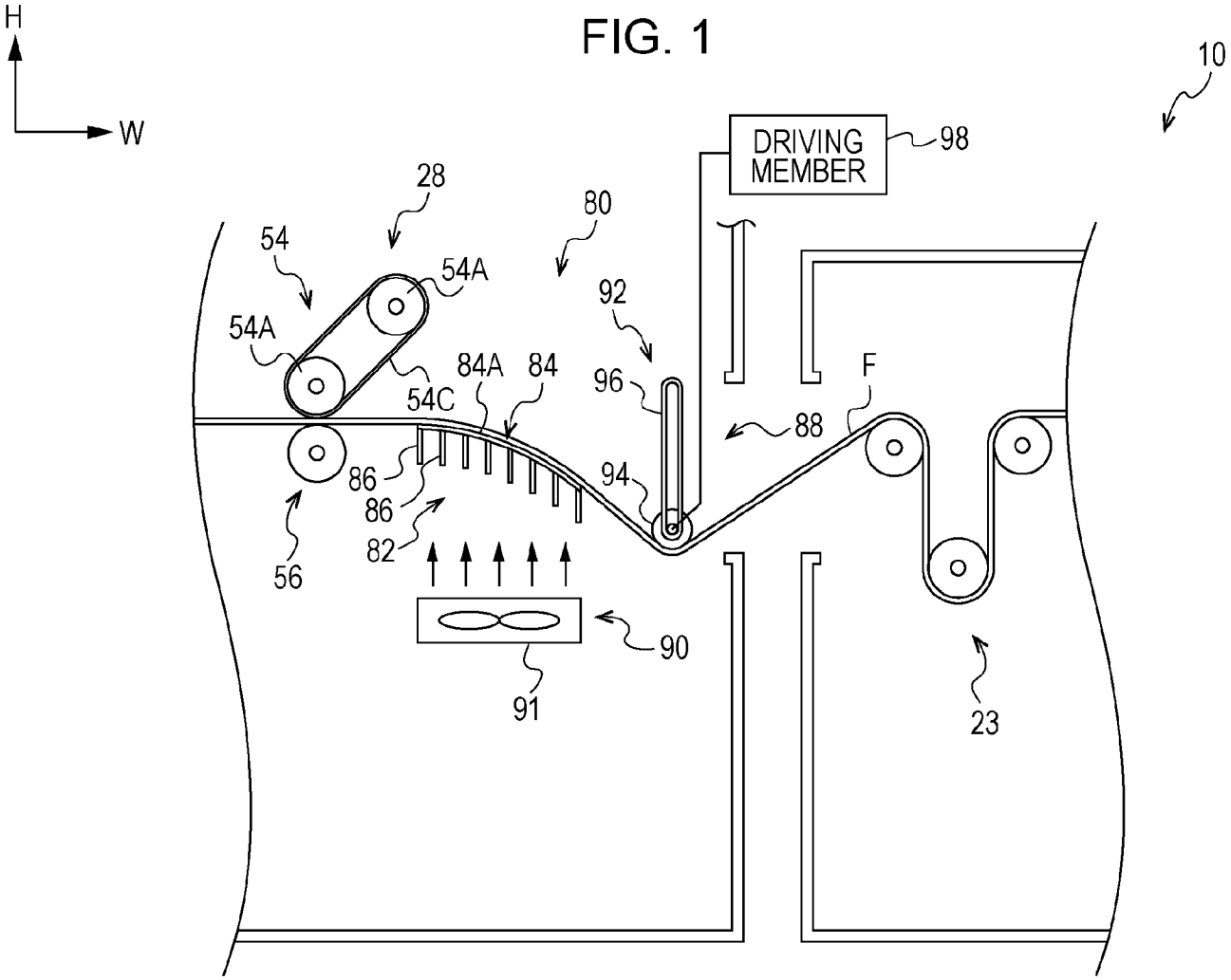
FIG. 1 illustrates the structure of a cooling device according to a first exemplary embodiment of the present invention and other devices.

A cooling device 80 and an image forming apparatus 10 according to a first exemplary embodiment of the present invention will be described with reference to FIGS. 1 to 8. In the drawings, the arrow H shows the up-down direction of the apparatus (vertical direction), the arrow W shows the width direction of the apparatus (horizontal direction), and the arrow D shows the depth direction of the apparatus (horizontal direction).

Overall Structure

Figure 8:
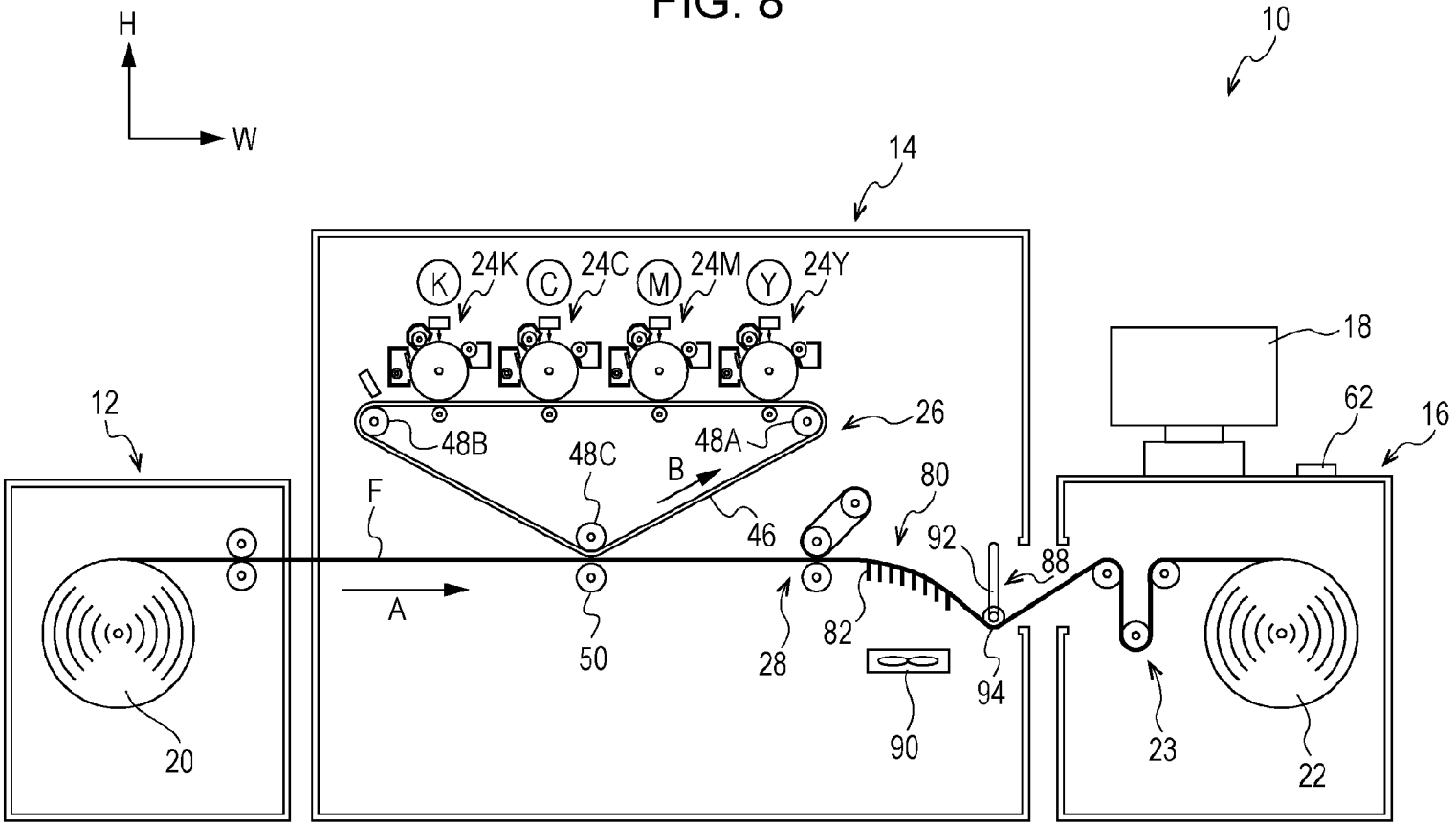
FIG. 8 is a schematic diagram illustrating the image forming apparatus according to the first exemplary embodiment of the present invention.

As illustrated in FIG. 8, the image forming apparatus 10 includes a feeder device 12 and an image forming section 14. The feeder device 12 feeds a shrink film F (hereinafter referred to as a "film F"), which is an example of a continuous resin film that serves as a recording medium. The image forming section 14 forms a toner image on the shrink film F fed by the feeder device 12. The image forming apparatus 10 also includes a container device 16 that contains the film F on which the toner image has been formed, and a controller 18 that controls each of the devices. The film F is a packaging material that shrinks when heated and that is used to pack, for example, a PET bottle. In the present exemplary embodiment, the film F is, for example, a 50 μm thick resin film made of polystyrene.

Feeder Device

The feeder device 12 feeds the film F to the image forming section 14. The feeder device 12 includes a feed roller 20 around which the film F is wound into a roll.

Container Device

The container device 16 contains the film F having the toner image formed thereon by the image forming section 14. The container device 16 includes a take-up roller 22 that is rotated by a driving unit (not shown) and around which the film F having the toner image formed thereon is wound into a roll, and a dancer roller 23 that adjusts the tension applied to the film F. The take-up roller 22 is an example of a transport unit that transports the film F.

Image Forming Section

The image forming section 14 forms a toner image on the film F on the basis of image information by using toners of four colors, which are yellow (Y), magenta (M), cyan (C), and black (K).

The image forming section 14 includes image forming devices 24, which are examples of image forming units that form a toner image, and an intermediate transfer device 26, which is an example of a transfer unit. The toner images formed by the image forming devices 24 are transferred onto the intermediate transfer device 26 in a first transfer process, and are then transferred onto the film F by the intermediate transfer device 26 in a second transfer process. The image forming section 14 also includes a fixing device 28 that fixes, by applying heat and pressure, the toner images that have been transferred onto the film F by the intermediate transfer device 26 in the second transfer process, and a cooling device 80 that cools a portion of the film F to which the toner images have been fixed.

Image Forming Devices

Four image forming devices 24Y, 24M, 24C, and 24K that form the toner images of the respective colors, which are yellow (Y), magenta (M), cyan (C), and black (K), are provided as the image forming devices 24. The image forming devices 24 of the respective colors have similar structures except for the toner that is used. In the following description, when it is not necessary to distinguish the image forming devices, the letters "Y", "M", "C", and "K" appended to the reference numeral 24 will be omitted.

Figure 7:
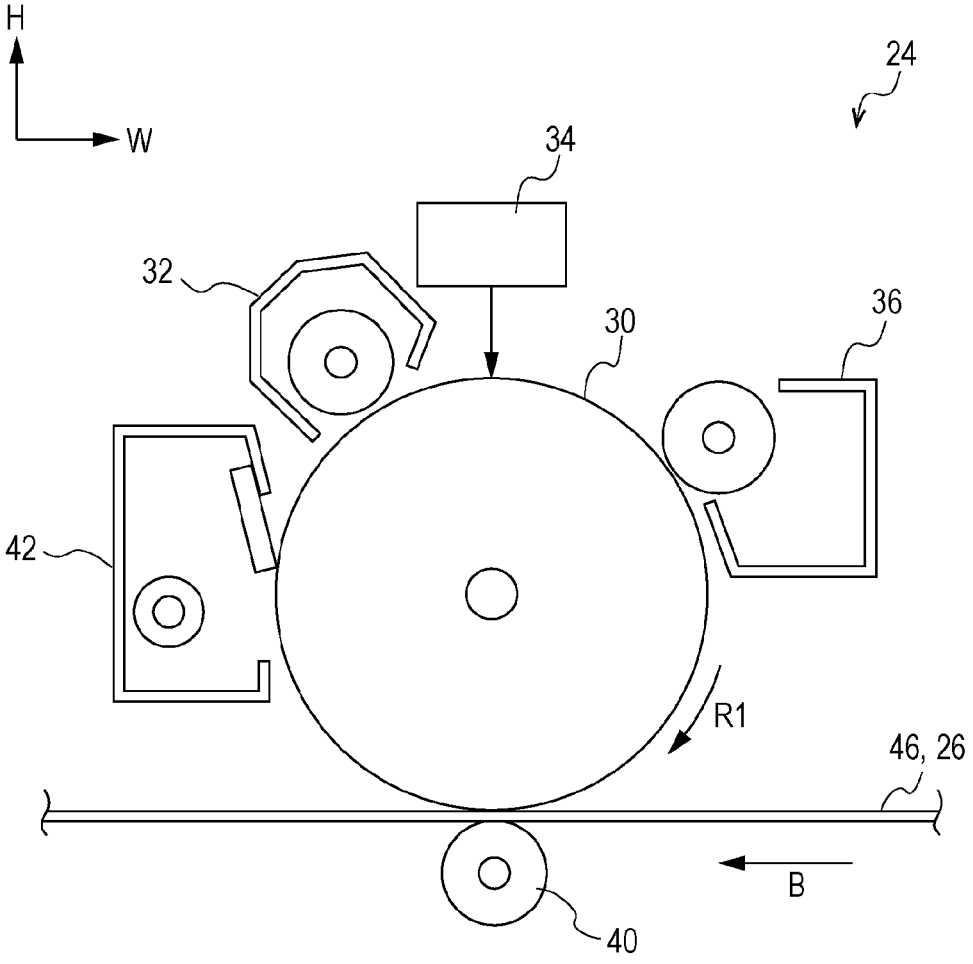
FIG. 7 is a diagram illustrating an image forming device included in the image forming apparatus according to the first exemplary embodiment of the present invention.

As illustrated in FIG. 7, each image forming device 24 includes a cylindrical image carrier 30 that rotates in the direction of arrow R1 in FIG. 1 and that carries a toner image. A charging device 32 that charges the image carrier 30, an exposure device 34 that irradiates the charged image carrier 30 with exposure light to form an electrostatic latent image, and a developing device 36 that develops the electrostatic latent image into a toner image are arranged around the image carrier 30 in that order from the upstream side in a direction in which the image carrier 30 is rotated.

The image forming device 24 also includes a transfer roller 40 and a cleaning device 42. The transfer roller 40 transfers the toner image on the image carrier 30 onto a transfer belt 46 in the first transfer process. The transfer belt 46 is included in the intermediate transfer device 26, and rotates in the direction of arrow B in FIG. 7. The cleaning device 42 removes the toner or the like that remains on the image carrier 30 after the first transfer process.

As illustrated in FIG. 8, the image forming devices 24Y, 24M, 24C, and 24K are arranged in that order from the upstream side in a direction in which the transfer belt 46 is rotated.

With this structure, the toner images formed by the image forming devices 24 are successively transferred onto the transfer belt 46 that rotates in the first transfer process, so that the toner images are superposed on the transfer belt 46.

Intermediate Transfer Device

As illustrated in FIG. 8, the intermediate transfer device 26 includes the above-described transfer belt 46 and rollers 48A, 48B, and 48C around which the transfer belt 46 extends. The roller 48A receives a rotating force from a driving unit.

The roller 48C is arranged so that the transfer belt 46 is in contact with the film F that is transported. The intermediate transfer device 26 also includes a transfer roller 50 that transfers the toner images formed on the transfer belt 46 onto the film F in the second transfer process.

In this structure, the intermediate transfer device 26 transfers the toner images formed on the transfer belt 46 onto the film F in the second transfer process.

Fixing Device

As illustrated in FIG. 1, the fixing device 28 includes a heating unit 54 that is heated to a predetermined temperature and that comes into contact with an image surface of the film F, and a pressing roller 56 that presses the film F that has been transported to the heating unit 54 at a non-image surface side of the film F. The non-image surface of the film F is a surface on which the toner images are not formed.

The heating unit 54 includes a pair of rollers 54A and a fixing belt 54C arranged so as to extend around the rollers 54A. At least one of the rollers 54A has a halogen heater (not shown) disposed therein. In addition, at least one of the rollers 54A receives a rotating force from a driving member (not shown).

In this structure, the fixing device 28 fixes the toner images that have been transferred onto the film F in the second transfer process to the film F while the film F is nipped and transported. At this time, the film F is heated to a temperature higher than the softening temperature of the film F.

Operation of Overall Structure

Next, an operation performed by the image forming apparatus 10 to form a toner image on the film F will be described.

The controller 18 controls each of the devices so that the image forming devices 24 form toner images of the respective colors. The toner images formed by the image forming devices 24 are successively transferred onto the transfer belt 46 that rotates in the first transfer process, so that the toner images are superposed on the transfer belt 46.

The intermediate transfer device 26 transfers the toner images formed on the transfer belt 46 onto the film F fed from the feeder device 12 in the second transfer process. The fixing device 28 fixes the toner images to the film F, and the cooling device 80 cools the film F.

The container device 16 receives the film F that has been cooled by the cooling device 80. Thus, the process of forming a toner image on the film F is completed.

Structure of Components

The cooling device 80 and other devices will now be described.

As illustrated in FIG. 1, the cooling device 80 includes a support member 82 that supports the film F, to which the toner image is fixed, at the non-image surface side of the film F, a cooling member 90 that cools the film F through the support member 82, and a pressing member 92 that presses the film F against the support member 82. The pressing member 92 is an example of a contact member.

Support Member

Figure 3:
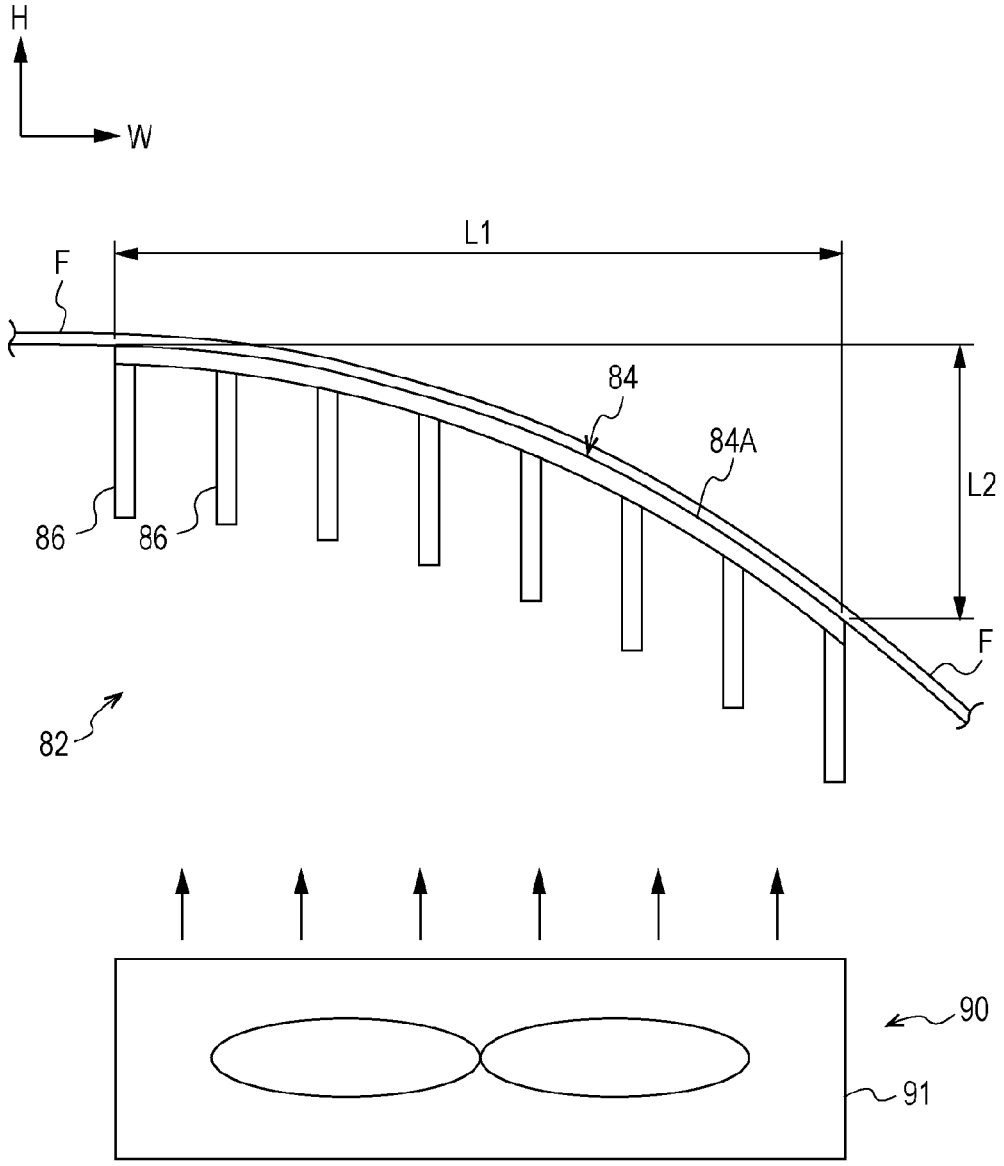
FIG. 3 is a side view of a support member included in the cooling device according to the first exemplary embodiment of the present invention.
Figure 4:
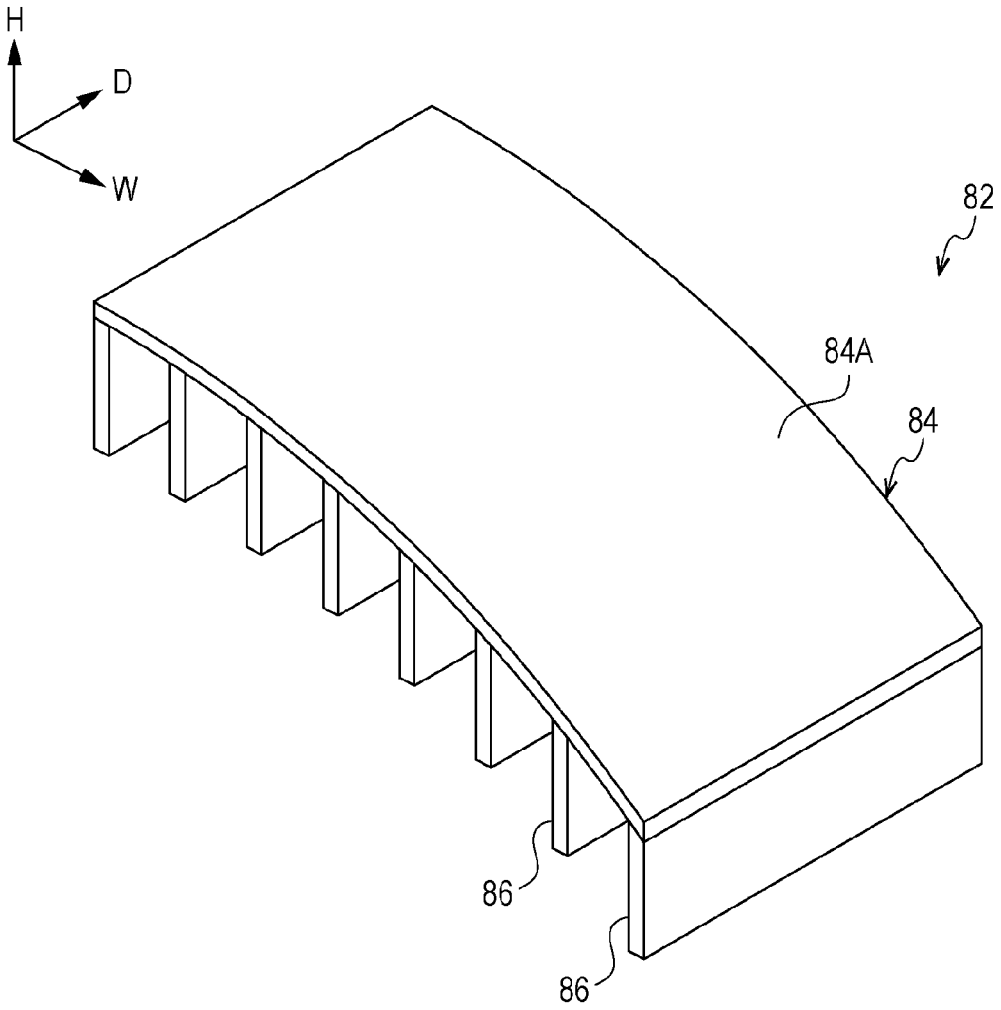
FIG. 4 is a perspective view of the support member included in the cooling device according to the first exemplary embodiment of the present invention.

As illustrated in FIGS. 3 and 4, the support member 82 includes a support plate 84 having a support surface 84A that supports the film F at the non-image surface side (back side), and plural heat dissipation plates 86.

The support surface 84A is convexly curved upward when viewed in the depth direction of the apparatus (width direction of the film F). When viewed in the depth direction of the apparatus, the curvature of the support surface 84A gradually decreases from the upstream side to the downstream side in a transporting direction in which the film F is transported.

The heat dissipation plates 86, which have surfaces that face in the width direction of the apparatus, are connected to the back surface of the support plate 84 (surface opposite the support surface 84A) at the proximal ends thereof. The heat dissipation plates 86 are arranged with constant intervals therebetween in the width direction of the apparatus.

Cooling Member

As illustrated in FIG. 1, the cooling member 90 includes a fan 91 that is disposed below the support member 82 and that blows air toward the heat dissipation plates 86 of the support member 82. By blowing air toward the heat dissipation plates 86, the fan 91 cools the film F from the side of the support member 82 at the non-image surface side of the film F.

More specifically, the fan 91 cools the film F at the non-image surface side of the film F to a temperature lower than or equal to the softening temperature of the film F. The softening point of the film F is close to the glass transition point of the film F.

Pressing Member

The pressing member 92 is located downstream of the support member 82 in the transporting direction of the film F, and includes a roller 94 capable of rotating while being in contact with the film F at the upper side of the film F.

In this structure, when the roller 94 is at a pressing position, which will be described below, the roller 94 presses the film F downward so that the non-image surface side of the film F comes into contact with the support surface 84A of the support plate 84 and the film F is supported by the support plate 84. Accordingly, the image surface side of the film F is convexly curved when viewed in the depth direction of the apparatus.

Others

The image forming apparatus 10 includes a switching unit 88 that switches a path of a recording medium between a first transport path (see FIG. 1) along which the recording medium is transported while being supported by the support member 82 and a second transport path (see FIG. 2) along which the recording medium is transported while being separated from the support member 82.

The switching unit 88 includes rails 96 that are disposed on both sides of the roller 94 and that support the roller 94 such that the roller 94 is movable in the vertical direction, and a driving member 98 that moves the roller 94 along the rails 96.

The operation of the driving member 98 is controlled by the above-described controller 18 (see FIG. 8).

Figure 2:
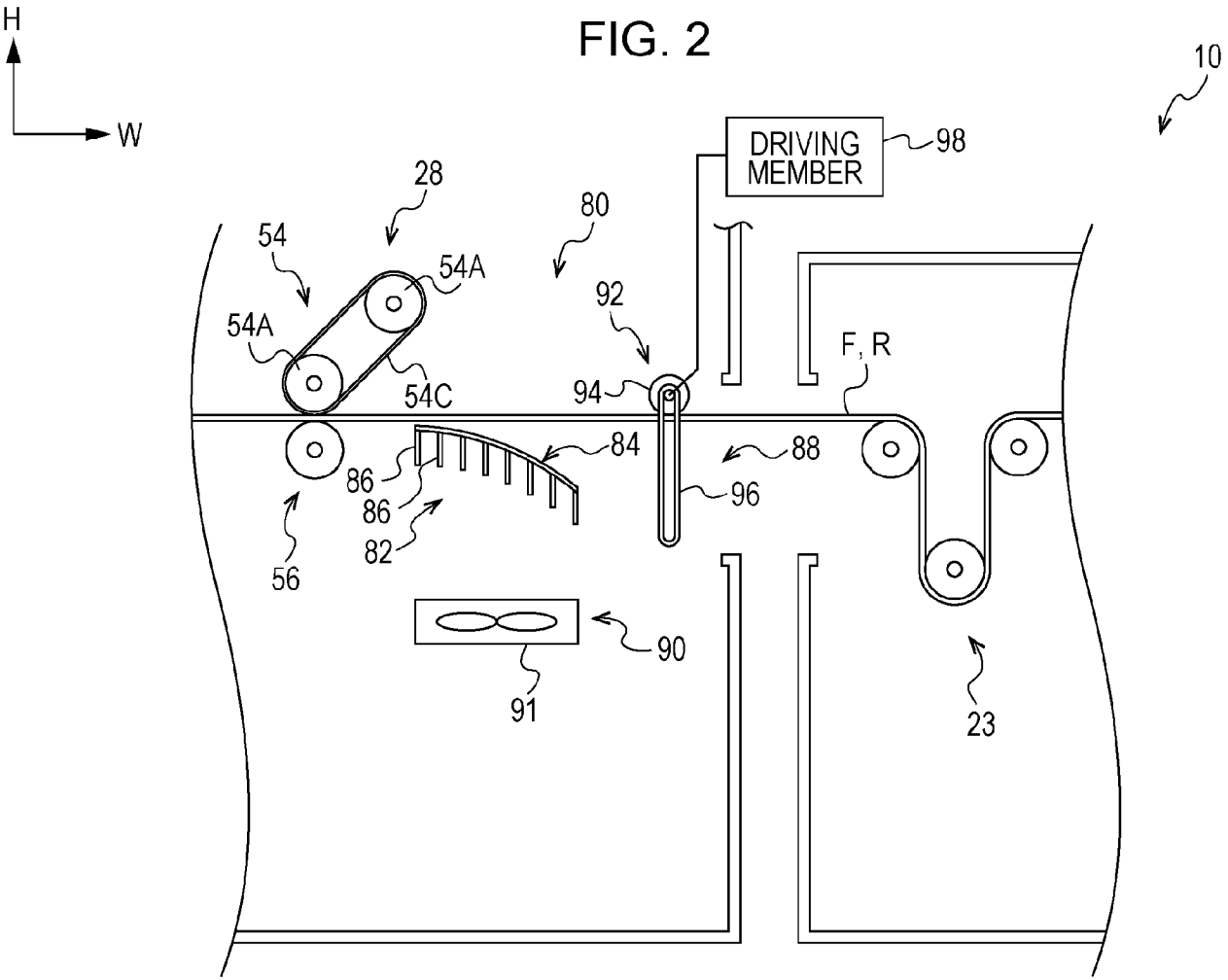
FIG. 2 illustrating the structure of the cooling device according to the first exemplary embodiment of the present invention and other devices.

In this structure, the controller 18 operates the driving member 98 so as to move the roller 94 between the pressing position illustrated in FIG. 1, at which the roller 94 presses the film F, and a separating position illustrated in FIG. 2, at which the pressing force is eliminated and the support plate 84 is separated from the film F. When the roller 94 is at the pressing position, the recording medium is transported along the first transport path. When the roller 94 is at the separating position, the recording medium is transported along the second transport path.

The image forming apparatus 10 also includes an input unit 62 (see FIG. 8) through which the user inputs a medium type when a recording medium other than the film F (label paper, normal paper, etc.) is used.

In this structure, when the medium type input through the input unit 62 differs from the film F, and when the roller 94 is at the pressing position, the controller 18 operates the driving member 98 to move the roller 94 to the separating position, as illustrated in FIG. 2. When the medium type input through the input unit 62 is the film F and the roller 94 is at the separating position, the controller 18 operates the driving member 98 to move the roller 94 to the pressing position, as illustrated in FIG. 1.

Operation

The operation will now be described. In the initial state, the roller 94 is at the pressing position, and the film F is transported along the first transport path.

The fixing device 28 fixes the toner image that has been transferred onto the film F in the second transfer process to the film F by applying heat and pressure. More specifically, the film F is transported while being nipped between the fixing belt 54C that is heated and the pressing roller 56, so that the toner image is fixed to the film F. Since the film F is heated by the fixing device 28 at the image surface side thereof, the temperature of the film F at the image surface side becomes higher than that at the non-image surface side.

After the toner image has been fixed to the film F, the roller 94 causes the non-image surface side of the film F to come into contact with the support surface 84A, as illustrated in FIG. 3, and the film F is supported such that the image surface side of the film F is convexly curved when viewed in the depth direction of the apparatus. In this state, the fan 91 cools the film F from the side of the support member 82 at the non-image surface side of the film F. A portion of the film F that has been cooled by the fan 91 is wound around the take-up roller 22 (see FIG. 8).

A case in which a recording medium of the type other than the film F (label paper) is used will now be described. A label paper is a sheet in which backing paper, an adhesive layer, and a surface material are stacked together.

In the case where the medium type input through the input unit 62 is label paper R, which differs from the film F, the controller 18 controls the driving member 98 so as to move the roller 94 to the separating position, as illustrated in FIG. 2. Accordingly, the label paper R that is transported is separated from the support member 82. Accordingly, the label paper R is transported along a second transport path.

The controller 18 does not activate the cooling member 90.

Evaluation

An image forming apparatus including the cooling device according to the present exemplary embodiment is evaluated. In addition, an image forming apparatus which does not include the cooling device is also evaluated as an image forming apparatus according to a comparative example to be compared with the present exemplary embodiment.

Evaluation Specification

1. Color 1000 Press manufactured by Fuji Xerox Co., Ltd. is used as each of the image forming apparatuses. The cooling device 80 is disposed downstream of a fixing device in the image forming apparatus according the present exemplary embodiment, and the cooling device 80 is not included in the image forming apparatus according to the comparative example. The fixing device heats the toner image on the film F (recording medium) at 160° C.

2. The film F used as the recording medium is Bonset (EPS45T) manufactured by C.I. Kasei Co., Ltd., which is a 50 μm thick polystyrene resin film having a softening point of 100° C. Here, Bonset (EPS45T) is a shrink film that shrinks in a transporting direction (longitudinal direction) when heated.

3. With regard to the shape of the support plate 84 of the support member 82, in FIG. 3, the dimension L1 is set to 300 mm and the dimension L2 is set to 60 mm. The curvature of the support surface 84A gradually varies from 1/700 (upstream side) to 1/900 (downstream side) when viewed in the depth direction of the apparatus.

4. In the state in which the film F that is transported is supported by the support member 82, the fan 91 cools the support member 82 such that the temperature of the support surface 84A is 120° C. in an upstream region thereof and 90° C. in a downstream region thereof.

5. A black solid image (area coverage (image density) 100%) is formed on the film F as the toner image.

6. The speed at which the film F is transported is 60 m/min.

Evaluation Items

The shrinkage ratio in the transporting direction and warping of the film F output from each image forming apparatus are evaluated. The shrinkage ratio is determined by cutting out a portion of the film F that has been output and measuring the distance between predetermined two points.

Evaluation Criterion and Evaluation Results

When the shrinkage ratio of the film F output from the image forming apparatus is less than 3.0% in the transporting direction of the film F, the film F is evaluated as "Good" since the commercial value thereof is not affected. When the shrinkage ratio is 3.0% or more, the film F is evaluated as "Bad" since the commercial value thereof is affected. Warping of the film F output from the image forming apparatus is visually evaluated.

In the image forming apparatus according to the present exemplary embodiment, the shrinkage ratio is 1.5% and the result of the evaluation is "Good". In the image forming apparatus according to the comparative example, the shrinkage ratio is 4.0% and the result of the evaluation is "Bad".

With regard to warping of the film F output from each image forming apparatus, warping of the film F output from the image forming apparatus according to the present exemplary embodiment is smaller than warping of the film F output from the image forming apparatus according to the comparative example.

Consideration

Figure 6A:
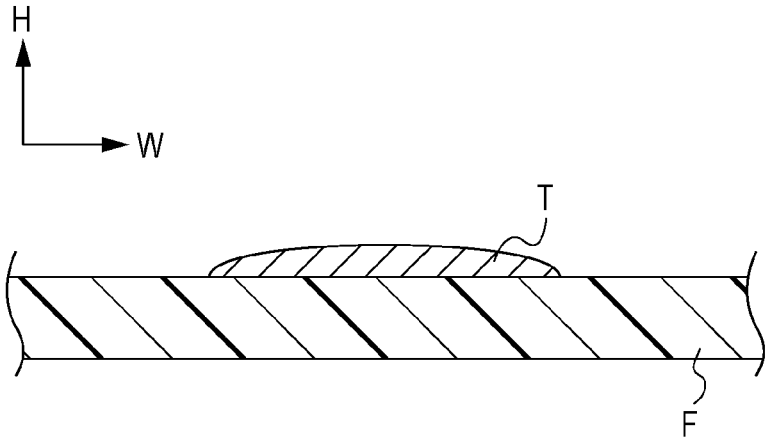
FIGS. 6A and 6B illustrate the manner in which a film warps in the case where the cooling device according to the first exemplary embodiment of the present invention is not used (in the case of comparative example)

In the image forming apparatus according to the comparative example, as illustrated in FIG. 6A, the film F is flat in the state in which the toner image T is transferred onto the film F.

Figure 6B:
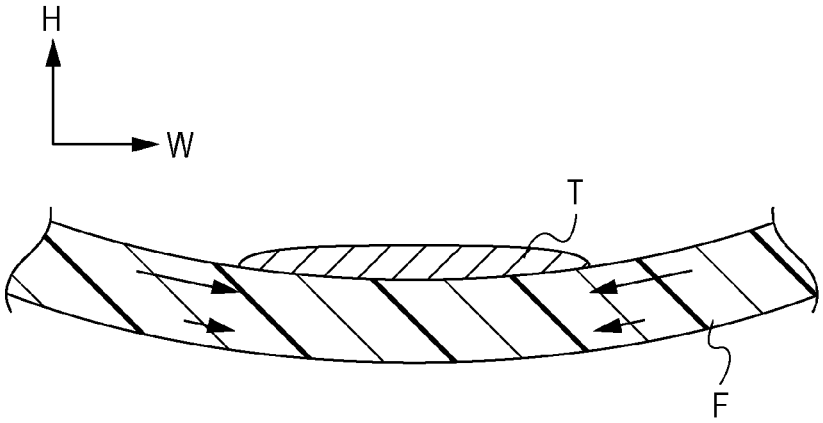

Since the film F is heated by the fixing device at the image surface side thereof, the temperature of the film F is higher at the image surface side than at the non-image surface side. Therefore, as illustrated in FIG. 6B, the image surface side of the film F shrinks by a larger amount than the non-image surface side of the film F, and the film F warps such that the image surface side thereof is concavely curved when viewed in the depth direction of the apparatus.

Figure 5A:
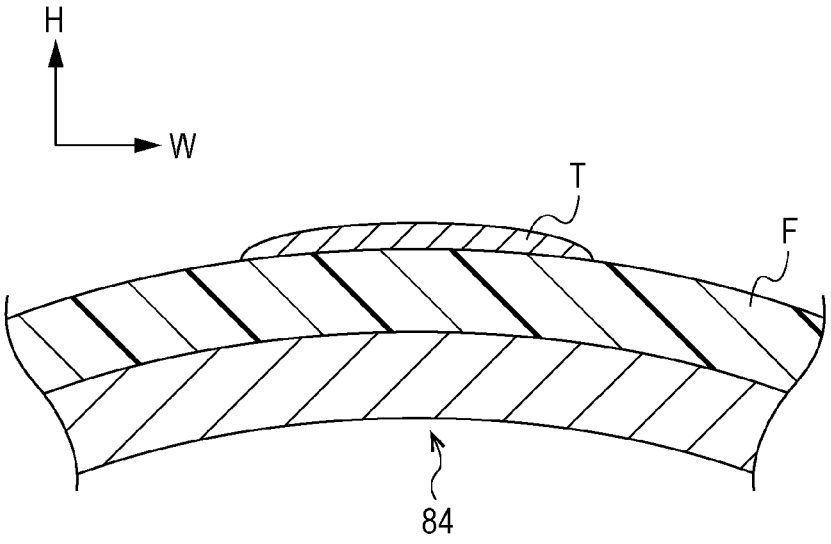
FIGS. 5A and 5B illustrate the manner in which a film warps in the case where the cooling device according to the first exemplary embodiment of the present invention is used.

In the image forming apparatus according to the present exemplary embodiment, similar to the comparative example, since the film F is heated by the fixing device at the image surface side thereof, the temperature of the film F is higher at the image surface side than at the non-image surface side. However, in this state, as illustrated in FIG. 5A, the film F is supported by the support member 82 such that the image surface side of the film F is convexly curved. In addition, in the state in which the film F is convexly curved, the film F is cooled by the fan 91 (see FIG. 1) through the support member 82.

Figure 5B:
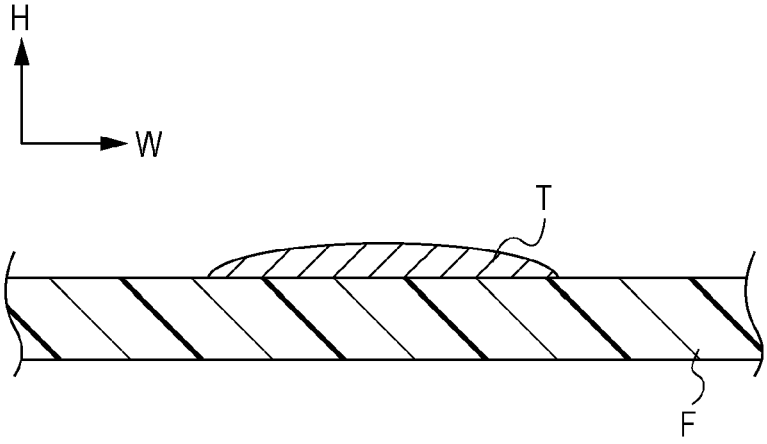

Therefore, shrinking of the film F is suppressed, and warping of the film F such that the image surface side thereof is concavely curved when viewed in the depth direction of the apparatus is also suppressed (see FIG. 5B).

Summary

In the case where the film F is cooled at the non-image surface side thereof, the film F may be more effectively cooled compared to the case where the film F is cooled at the image surface side thereof. In addition, warping of the film F due to the temperature of the film F being higher at the image surface side than at the non-image surface side is suppressed.

Moreover, since the film F is cooled in the state in which the image surface side of the film F is convexly curved, compared to the case in which the film F is not curved, warping of the film F due to the temperature of the film F being higher at the image surface side than that at the non-image surface side is more effectively suppressed.

The support surface 84A of the support member 82 is convexly curved when viewed in the depth direction of the apparatus. Therefore, in the case where the film F that shrinks in the transporting direction (longitudinal direction) when heated is used, compared to the case in which the support surface is convexly curved when viewed in the transporting direction of the film F, warping of the film F is more effectively suppressed.

The curvature of the support surface 84A gradually decreases from the upstream side to the downstream side in the transporting direction of the film F. Therefore, compared to the case in which the support surface has a constant curvature, warping of the film F along the support surface 84A is reduced.

In the image forming apparatus 10, when a recording medium of the type other than the film F (for example, label paper R) is used, the label paper R that is transported is separated from the support member 82. Therefore, in the case where, for example, an adhesive layer of the label paper R is partially exposed at the backing-paper side, the risk that the adhesive layer of the label paper R will adhere to the support member 82 is reduced.

Second Exemplary Embodiment

A cooling device 100 and an image forming apparatus according to a second exemplary embodiment of the present invention will now be described with reference to FIG. 9. Components similar to those in the first exemplary embodiment are denoted by the same reference numerals, and the description thereof is thus omitted. Structures different from those in the first exemplary embodiment will be described.

Figure 9:
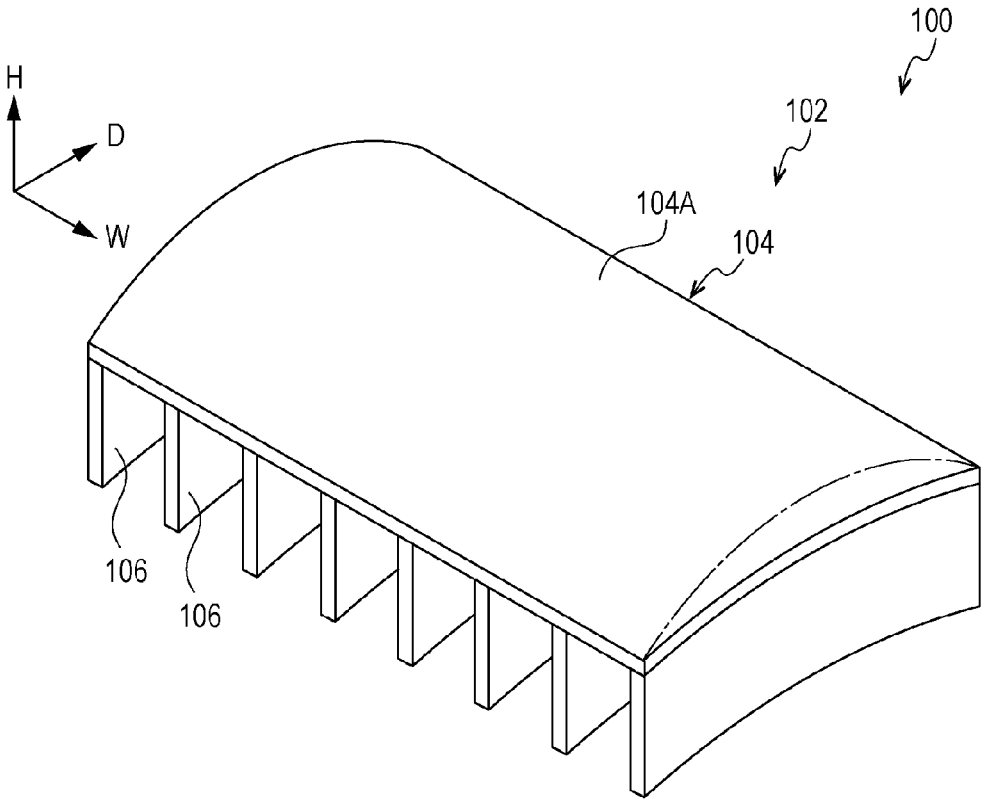
FIG. 9 is a perspective view of a support member included in a cooling device according to a second exemplary embodiment of the present invention.

As illustrated in FIG. 9, the cooling device 100 according to the second exemplary embodiment includes a support member 102 including a support plate 104 having a support surface 104A that supports the film F at the non-image surface side, and plural heat dissipation plates 106.

The support surface 104A is convexly curved when viewed in the transporting direction of the film F. The curvature of the support surface 104A gradually decreases from the upstream side to the downstream side in the transporting direction of the film F.

The heat dissipation plates 106, which have surfaces that face in the width direction of the apparatus, are connected to the back surface of the support plate 104 (surface opposite the support surface 104A) at the proximal ends thereof. The heat dissipation plates 106 are arranged with constant intervals therebetween in the width direction of the apparatus.

In this structure, in the case where the film F that shrinks in the width direction of the film F when heated is used, compared to the case in which the support surface is convexly curved when viewed in the depth direction of the apparatus, warping of the film F is more effectively suppressed.

The effects of the second exemplary embodiment are similar to those of the first exemplary embodiment except for the effect provided because the support surface is convexly curved when viewed in the depth direction of the apparatus.

Although specific exemplary embodiments of the present invention have been described in detail, the present invention is not limited to the above-described exemplary embodiments. It is obvious to a person skilled in the art that various exemplary embodiments are possible within the scope of the present invention. For example, in the above-described first and second exemplary embodiments, the recording medium cooled by the cooling device 80 is the film F (shrink film). However, the recording medium is not limited to a shrink film as long as the recording medium is a resin-made film (resin film).

In addition, although the support member 82, 102 includes plural heat dissipation plates 86, 106 in the first and second exemplary embodiments, the heat dissipation plates may be omitted when a support member having a high thermal conductivity is used.

Although not described in the first and second exemplary embodiments, a member that directly presses the film F against the support surface 84A, 104A from above the support member 82, 102 by nipping the film F between itself and the support surface 84A, 104A may be additionally provided.

In addition, although not described in the first and second exemplary embodiments, the support surface 84A, 104A of the support member 82, 102 may be convexly curved not only when viewed in the depth direction of the apparatus but also when viewed in the transporting direction of the film F. Such a structure is effective in the case where the recording medium is a shrink film that shrinks in all directions when heated.

Although the roller 94 is moved by the driving member 98 in the above-described exemplary embodiments, the roller 94 may instead be moved by the user.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cooling device for cooling a continuous resin film, the cooling device comprising:

a support member having a convexly curved support surface and configured to support the continuous resin film at a non-image surface side of the continuous resin film, whereby the support surface contacts the non-image surface side of the continuous resin film, wherein the continuous resin film, having a toner image fixed thereon, is cooled in such a state that an image surface side of the continuous resin film is convexly curved, and wherein the support surface of the support member is convexly curved when viewed in a direction in which the continuous resin film is transported.

2. The cooling device according to claim 1, comprising:

a contact member configured to cause the support surface to be in contact with the continuous resin film and configured to support the resin continuous film in such a manner that the image surface side of the continuous resin film is convexly curved; and a cooling member configured to cool the continuous resin film from the side of the support member at the non-image surface side of the continuous resin film.

3. The cooling device according to claim 2, wherein the support surface of the support member is convexly curved when viewed in a width direction of the continuous resin film.

4. The cooling device according to claim 2, wherein the support surface has a curvature that gradually decreases from an upstream side to a downstream side in a direction in which the continuous resin film is transported.

5. An image forming apparatus comprising:

a transport unit configured to transport a continuous resin film configured to serve as a recording medium;

an image forming unit configured to form a toner image;

a transfer unit configured to transfer the toner image formed by the image forming unit onto the continuous resin film transported by the transport unit;

a fixing unit configured to fix the toner image to the continuous resin film by heating the toner image; and the cooling device according to claim 1 configured to cool the continuous resin film to which the toner image has been fixed by the fixing unit.

6. An image forming apparatus comprising:

a transport unit configured to transport a recording medium;

an image forming unit configured to form a toner image;

a transfer unit configured to transfer the toner image formed by the image forming unit onto the recording medium transported by the transport unit;

a fixing unit configured to fix the toner image to the recording medium by heating the toner image;

the cooling device according to claim 1 that is located downstream of the fixing unit in a direction in which the recording medium is transported; and a switching unit configured to control the contact member to perform switching between a first transport path along which the recording medium is transported while being supported by the support member and a second transport path along which the recording medium is transported while being separated from the support member.

7. A cooling device for cooling a continuous resin film, the cooling device comprising:

a support member having a convexly curved support surface and configured to support the continuous resin film at a non-image surface side of the continuous resin film, whereby the support surface contacts the non-image surface side of the continuous resin film, wherein the continuous resin film, having a toner image fixed thereon, is cooled at a non-image surface side of the continuous resin film while the continuous resin film is in contact with the support member that supports the continuous resin film at the non-image surface side of the continuous resin film, and wherein the support surface of the support member is convexly curved when viewed in a direction in which the continuous resin film is transported.

8. A cooling method comprising:

heating a continuous resin film;

fixing a toner image to the continuous resin film; and cooling the continuous resin film, wherein the support surface contacts the non-image surface side of the continuous resin film during cooling, wherein the continuous resin film is supported by a support surface of a support member such that the support surface of the support member is convexly curved when viewed in a direction in which the continuous resin film is transported.

* * * * *